United States Patent [19]

Laplante

[11] Patent Number: 4,535,971

[45] Date of Patent: Aug. 20, 1985

[54] PROPULSIVE-FORCE JACK INSTALLATION FOR PRODUCING THE CONTINUOUS MOVEMENT OF AN OBLONG OBJECT IN THE DIRECTION OF ITS AXIS, AND/OR FOR MOVING AN ELEMENT ALONG SAID OBJECT

[75] Inventor: Gilbert Laplante, La Croix Valmer, France

[73] Assignee: Compagnie Francaise d'Enterprises Metalliques, France

[21] Appl. No.: 559,017

[22] Filed: Dec. 8, 1983

Related U.S. Application Data

[63] Continuation of Ser. No. 329,997, Dec. 11, 1981, abandoned.

[30] Foreign Application Priority Data

Dec. 16, 1980 [FR] France ..... 80 26697

[51] Int. Cl.[3] ..... B66F 1/00

[52] U.S. Cl. ..... 254/108; 91/191

[58] Field of Search ..... 254/105–106, 254/108–111; 91/189 R, 191, 195, 533, 437, 444; 92/75

[56] References Cited

U.S. PATENT DOCUMENTS

| | | | |
|---|---|---|---|
| 3,537,684 | 11/1970 | Stine et al. | 254/106 |
| 3,895,778 | 7/1975 | Ahlgren | 254/106 X |
| 3,940,109 | 2/1976 | Ahlgren | 254/106 |
| 3,990,349 | 11/1976 | Valantin | 91/191 X |
| 4,109,975 | 8/1978 | Mattson | 254/108 X |
| 4,234,163 | 11/1980 | Kormendy | 254/108 |
| 4,286,771 | 9/1981 | Kormendy | 254/108 |

*Primary Examiner*—Frederick R. Schmidt
*Assistant Examiner*—Steven P. Schad
*Attorney, Agent, or Firm*—Larson and Taylor

[57] ABSTRACT

The invention provides a propulsive-force jack installation for producing the continuous movement of an oblong object (1) in the direction of its axis and it is characterized in that it comprises two jack assemblies whose pistons (6, 6') work in seesaw fashion, a piston (6) of one assembly taking in charge said object (1) as soon as the piston (6') of the other assembly ceases this action, offload movement of the piston (6 or 6') and its locking on the object (1) being controlled automatically just before the arrival at the end of travel under load of the other piston (6' or 6) and the offload descent of one piston (6 or 6') being controlled automatically at a time which follows the beginning of the taking in charge of the object by the other piston (6' or 6). The invention may be applied to hoisting, self-raising, prospection, or working platforms at sea.

8 Claims, 4 Drawing Figures

1
2
3
3a
3b
3c
4
5
6
6'
7
7'
8
8'
9
9'
10
11
11'
12
12'
13
13'
14
14'
15
16
16'
17
17'
18
19
19'
20
20'
21
21'
22
22'
23
23'
N1
N2
N3
N4
N'1
N'2
N'3
N'4

PROPULSIVE-FORCE JACK INSTALLATION FOR PRODUCING THE CONTINUOUS MOVEMENT OF AN OBLONG OBJECT IN THE DIRECTION OF ITS AXIS, AND/OR FOR MOVING AN ELEMENT ALONG SAID OBJECT

This application is a continuation of application Ser. No. 329,997 filed 12/11/81 now abandoned.

The present invention relates to a propulsive-force jack installation for producing the continuous movement of an oblong object in the direction of its axis, and/or for moving an element along said object.

By "oblong object" is meant any kind of elongated object, such as a bar, rod, tube, cable, etc. having a uniform section or not, it being understood that by "axis" is meant the general direction in which said object extends, and not necessarily an axis in the geometrical meaning of the term, i.e. an axis of revolution or of symmetry.

The object in question may form any moving mechanical member, for example a hoisting member, the installation in question being then fixed. It may on the contrary be fixed such as a post, in which case the installation in question is movable along this object and may in its turn drive, for example for hoisting it, any element whatsoever.

Propulsive-force installations are already known for producing the movement of an oblong object, or of an element along such an object, comprising more especially jacks, but none are known up to present capable of producing a perfectly continuous movement of the object or of the element, without jerking, and without stoppage time, i.e., time lost during intermittent stopping and starting movements.

The aim of the present invention is to fill this gap in the technique and, to this end, a propulsive-force jack installation in accordance with the invention is characterized in that it comprises, on the one hand, at least two jack assemblies, the piston(s) of each assembly being associated with locking means adapted to interlock them selectively, momentarily and automatically to said object, their body being fixed (in the case of a movable oblong object) or movable and interlocked with an element to be moved along said object (in the case of a fixed oblong object) and, on the other hand, a device for supplying the jack bodies with hydraulic fluid, provided with automatic means (pumps; electromagnetic valves; position sensors; amplifiers, etc.) for controlling the delivery and the discharge of fluid on each side of said pistons, the arrangement and the operation of said locking and control means being provided so that, at least, the piston(s) of one of the jack assemblies takes charge of said object without discontinuity at the moment when the piston(s) of the other jack assembly themselves cease to take charge of said object, the piston(s) of one assembly having with respect to those of the other assembly, and in synchronism, a general seesaw movement.

By "general seesaw movement" it is intended to indicate that, in a general way, the piston(s) of one of the jack assemblies rise whereas the piston(s) of the other assembly descend, and conversely, these movements being synchronized. It will in any case be understood that with such an installation, an essentially continuous jerkless movement of the object of other moving element may be obtained, the piston(s) of one jack assembly taking over from the piston(s) of the other assembly, without any interruption, by exerting their driving force on the object or element to be moved, as soon as this or these elements of the other assembly cease to exert this force.

The invention may comprise other arrangements, particularly so as to allow a perfectly synchronized seesaw movement between said pistons of the jack assemblies, and so as to allow ready locking on the object, and in particular the above-defined installation in the most general form may further be characterized, to this end, in that the arrangement and the operation of said locking and control means are further ensured so that the beginning of an offload movement of the piston(s) of one of the jack assemblies in the relative moving direction of said object with respect to this assembly, and the locking thereof on the object, are controlled automatically at a moment which precedes the arrival at the end of their travel, under load and moving in the same direction, of the piston(s) of the other jack assembly.

This arrangement will be better seen further on, particularly from reading the description of one embodiment which will be given below with reference to the drawing, but it may already be noted that it allows the locking of the piston(s) of one of said assemblies with respect to this object to be effected conveniently, and without stopping the relative movement of the object in question with respect to said assemblies, during the beginning of offload travel of these pistons, and this without appreciable stresses being exerted between the object and the locking means.

With the same ends in view, it may further be provided that the arrangement and the operation of said locking and control means are further ensured so that from a stopped position at the end of underload travel, and after unlocking, the beginning of the offload return of the piston(s) of one jack assembly to their starting position, i.e. the beginning of their offload movement in the opposite direction to the relative movement of the object with respect to this assembly, is controlled automatically at a moment which follows the beginning of the taking in charge of said object by the piston(s) of the other jack assembly.

It will be understood that the lapse of time which elapses between this beginning of taking in charge and the moment in question may correspond approximately to the time required to ensure unlocking at the end of under-load travel. This also will be better seen further on.

From the point of view of the practical construction, any method of construction adapted to the problem posed may be provided for the jack assemblies of the installation in accordance with the invention, and more particularly it may comprise two jack assemblies each comprising an annular piston surrounding said oblong object, the two pistons being mounted in a common jack body also annular and surrounding said object.

This arrangement advantageously allows a compact and robust installation to be obtained, and also allows simplifications, the chambers of the two jack assemblies being able to communicate directly inside the body of the common jack body. In this way the mechanical connection (by means of bolts or similar) between the pistons and the oblong object may also be facilitated.

Other arrangements may however be provided, and especially for the installation to comprise two jack assemblies each comprising an annular piston surrounding said oblong object, the two pistons being mounted in two separate jack bodies, also annular, coaxial and surrounding said object.

There may be further provided, in some cases of application, conventional pairs of jacks or double-piston monojacks mounted about said oblong object in an arrangement allowing balancing of the forces of the pistons and an overall or resultant action directed along the axis of said object.

Whatever the embodiment chosen, there may further be used for actuating said locking and control means, any appropriate detection, regulation and other means, current in the kind of technique in question, and it may more especially be provided that the jack body (bodies) be associated with sensors detecting the position of the piston in the corresponding body, these sensors being connected, through amplifiers or similar, on the one hand to the electromagnetic valves or similar, adapted to control the delivery or the discharge of the hydraulic fluid into or out of the jack bodies, on one side or the other of the piston whose position is detected and/or of the piston of other jacks and, on the other hand, to said locking means, so as to ensure momentary locking or unlocking between pistons and oblong object.

Embodiments of the invention will now be described by way of examples which are in no wise limiting, with reference to the figures of the accompanying drawings in which.

Figure 1:
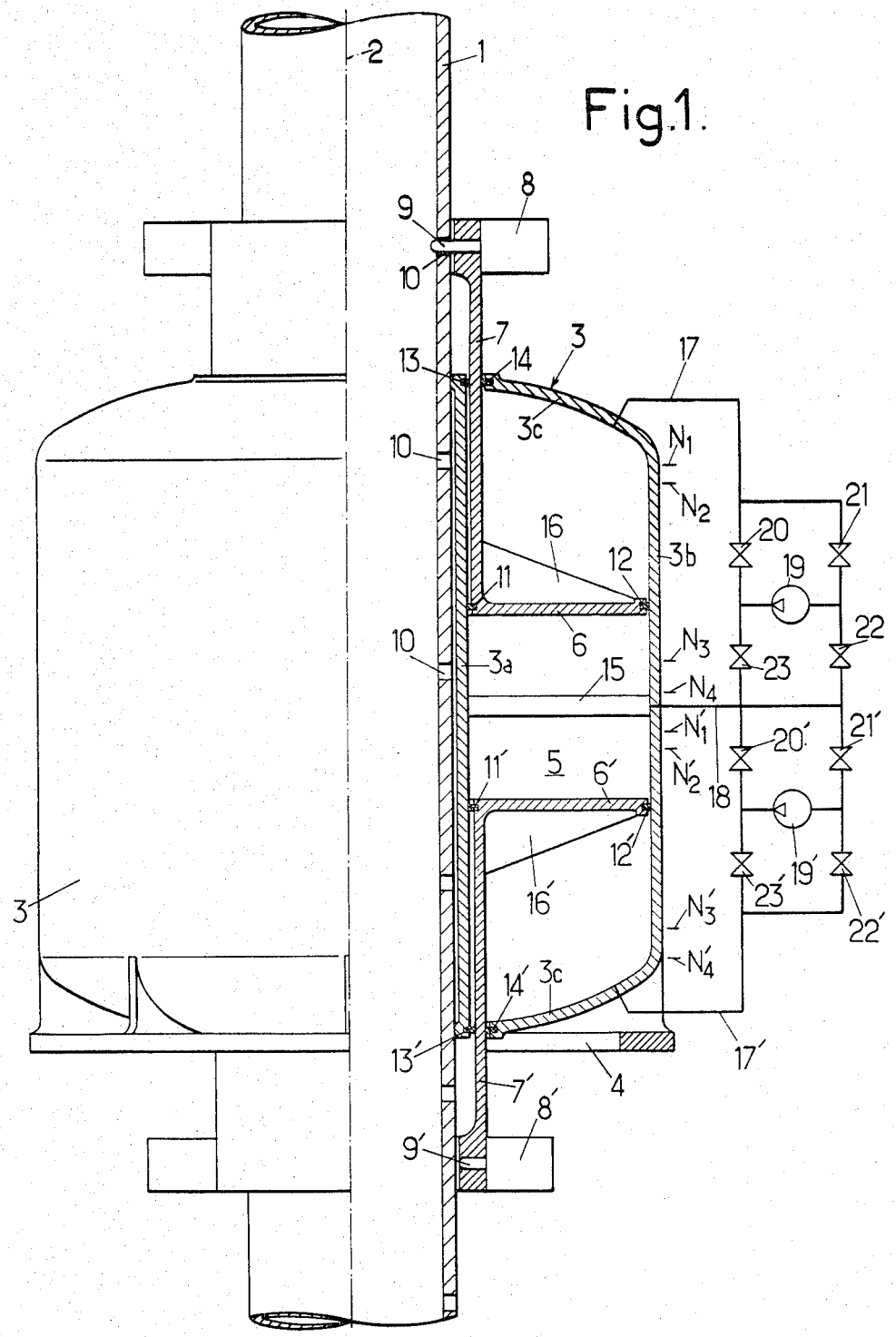
FIG. 1 shows schematically an installation in accordance with the invention, of the type comprising a common annular jack body with two jack assemblies, this body being shown in half-section and external half-view.

In FIG. 1 there is shown at 1, in the form of a tube, the oblong object which the jack assembly is desired to cause to undergo continuous movement in the direction of its axis 2. The jack assembly comprises in this example two jacks having a common body 3 mounted, on a fixed support 4, so as to surround said tube 1. The body 3 is formed of two cylindrical and concentric walls 3*a* and 3*b* connected at both ends by means of bottoms 3*c*, thus defining in body 3 a common annular chamber 5. The diameter of the inner tubular wall 3*a* is slightly greater than that of tube 1.

In the annular chamber 5 are slidably mounted two annular pistons 6 and 6' each extended by a tubular part, respectively 7 and 7' projecting from common body 3 through both ends thereof and each of which supports at its end locking means, respectively 8 and 8'. These means may be formed by any means adapted to provide momentary locking of the corresponding tubular part 7 or 7' on tube 1; they may for example be locking means comprising pins or similar, respectively 9 and 9', adapted to move radially towards axis 2 or in the opposite direction, either for engagement in an aperture or similar 10 of the tube or for disengagement therefrom, it being understood that the apertures 10 may be spaced apart with constant spacing both along the length of the tube and its periphery.

As for the seal between pistons 6, 6' and their respective tubular part 7, 7' on the one hand and the common jack body 3 on the other, it may be provided here again by any appropriate means and for example, as shown in the drawings, by annular seals, respectively 11 to 14 and 11' to 14'.

There is also shown in the drawings, at 15, a cross-piece connecting together the two cylindrical walls 3*a* and 3*b* but leaving the upper and lower parts of the chamber 5 in communication, and, at 16, 16', strengthening webs or similar for the pistons 6, 6'.

In FIG. 1, the circuit for supplying chamber 5 with hydraulic fluid has been shown very schematically. It comprises more especially ducts 17 and 17' opening into both ends of the chamber, after passing through the bottoms 3*c*, and a duct 18 opening into the central part of the chamber after passing through the cylindrical wall 3*b*, these different ducts may be placed in communication with pumps 19 and 19' through valves, respectively 20 to 23 and 20' to 23', these valves being connected in the arrangement shown in the drawings.

The position, with respect to the direction of axis 2, of pistons 6, 6' in chamber 5 may be determined by means of position sensors (not shown) which allow the times to be determined when these pistons arrive, for piston 6 at the levels indicated by the marks N1, N2, N3 and N4, and for piston 6' at the levels indicated by the marks N'1, N'2, N'3 and N'4.

So as not to overload the drawings, the control connections between the level sensors and on the one hand locking means 8, 8' and, on the other hand, the different valves 20 to 23 and 20' to 23' have not been shown either. From the explanations which follow concerning the operation of the installation which has just been described it can easily be seen how these operative connections between the different members of the installation may be effected.

Figure 4:
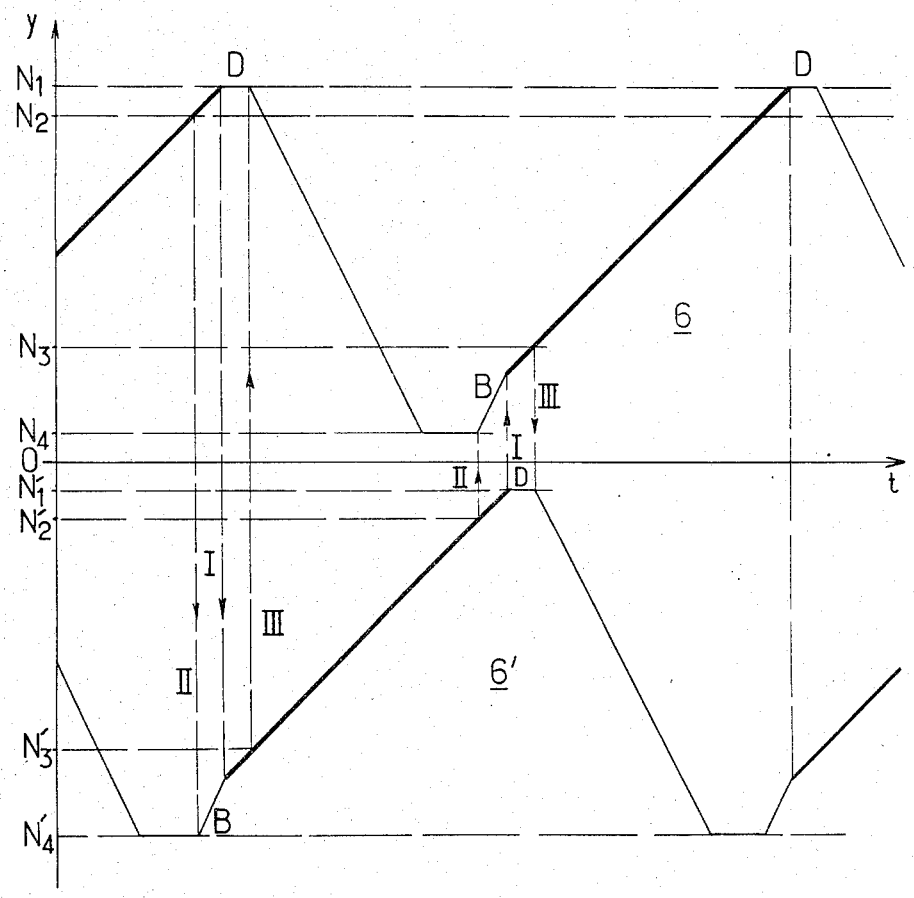
FIG. 4 is an example of one of the possible diagrams representing, as a function of time, the movements of the pistons of said jack assemblies.

Reference will now be made to FIGS. 1 and 4 for this explanation of the operation of the installation.

In FIG. 4, time is plotted along the abscissa and the position of piston 6, 6' in the direction of axis 2 is plotted along the ordinate. The thick line parts of the two diagrams shown in this figure designate the movements of the pistons under load, i.e. when through pins 9 or 9' they exert a thrust (which will be assumed to be directed upwards in FIG. 1) on the tube or other oblong object 1.

It has been assumed that at time t=0, piston 6 rises under load whereas piston 6' descends (in FIG. 4, there has been shown for the under-load rising movements slopes less, in absolute value, than the offload descent slopes). At that time, valves 21, 23, 20' and 22' are open, whereas valves 20, 22, 21' and 23' are closed.

When piston 6' reaches its lower level N'4, the automatic control causes valves 21' and 23' to open and so this piston to stop in a low position.

When piston 6 arrives at level N2, valves 20' and 22' close, which causes piston 6' to rise and pin 9' to thereafter be locked in the corresponding aperture 10 of tube 1 (see the referenced part B in FIG. 4).

When piston 6 arrives at level N1, valves 20 and 22 open, which causes this piston to stop and the unlocking, i.e. the extraction of pin 9 from the corresponding aperture 10 (operation designated by the letter D in FIG. 4), is also controlled automatically through means 8. It should be noted that this unlocking may be conveniently effected because piston 6 at that time exerts no force on tube 1.

When piston 6', which has begun to rise under load, driving tube 1, from the time when piston 6 finished exerting this action, arrives at level N'3, valves 21 and 23 are caused to close automatically which causes piston 6 to descend, piston 6' continuing to rise under load.

When piston 6 arrives at level N4, valves 21 and 23 open, which causes this piston to stop.

When piston 6' then arrives at level N'2, valves 20 and 22 are caused to close simultaneously so as to drive piston 6 again upwardly and pin 9 thereafter to be locked in the corresponding aperture 10 (reference B).

When piston 6' arrives at level N'1, valves 20' and 22' are caused to open automatically, which results in the stopping of this piston and therefore the taking in charge of tube 1 by piston 6. Pin 9' is unlocked (reference D).

When piston 6 arrives at level N3, valves 21' and 23' are caused to close automatically, which results in piston 6' descending.

We have then come back to the starting point and the cycle continues exactly in the same way.

In FIG. 4, there is shown schematically by vertical broken lines I, II and III the operative interconnections between the controls of pistons 6 and 6'.

Line I shows clearly that the taking in charge of tube 1 by piston 6' follows immediately the end of the taking in charge of this tube by the other piston 6, just as the taking in charge of the tube by piston 6 follows immediately the end of the taking in charge of this tube by piston 6'.

Line II shows when a piston arrives under load at level N2 or N'2, it automatically controls the beginning of the rise of the other piston and its locking with respect to tube 1.

Finally, line III shows that when a piston arrives under load at level N3 or N'3, it automatically controls the beginning of the offload downward movement of the other piston.

It should be emphasized that the diagrams shown in this FIG. 4 have only been given by way of illustration to show one possible example of operation, but that it would be possible to envisage many others.

It should be further noted that the addition to the installation which has just been described of adequate devices could also allow different security or other conditions to be obtained, stopping with load on the two pistons, or else reversal of the direction of movement of object 1 or reversal of the direction of the force exerted theron.

In fact, object 1 may be more especially an object to be hoisted, or on the contrary an object to be lowered, for example to drive it into the ground, for driving in, drilling or similar. This object 1, instead of being movable, as in the example which has just been described, could also be formed by a fixed post, and in this case of course it is the common jack body 3 which would move, similarly in a perfectly continuous way, along object 1, while driving along any element, for example an element to be hoisted to the top of the post or similar. Numerous applications of this type in the technique of oil drilling may be more especially contemplated, and in particular but not in a limiting manner for hoisting self-raising prospecting or working platforms at sea.

Figure 2:
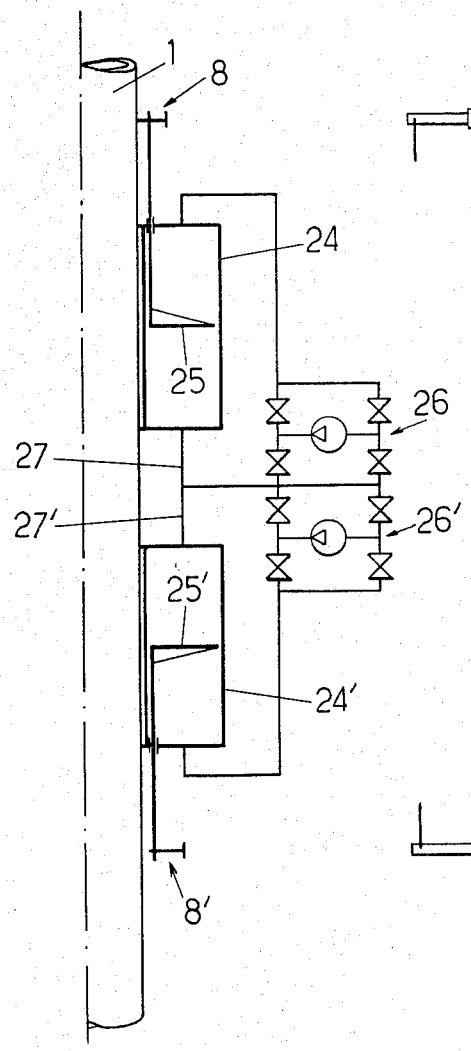
FIG. 2 shows similarly schematically another installation in accordance with the invention, of the type comprising two annular piston jack assemblies, the annular pistons being here mounted in separate jack bodies.
Figure 3:
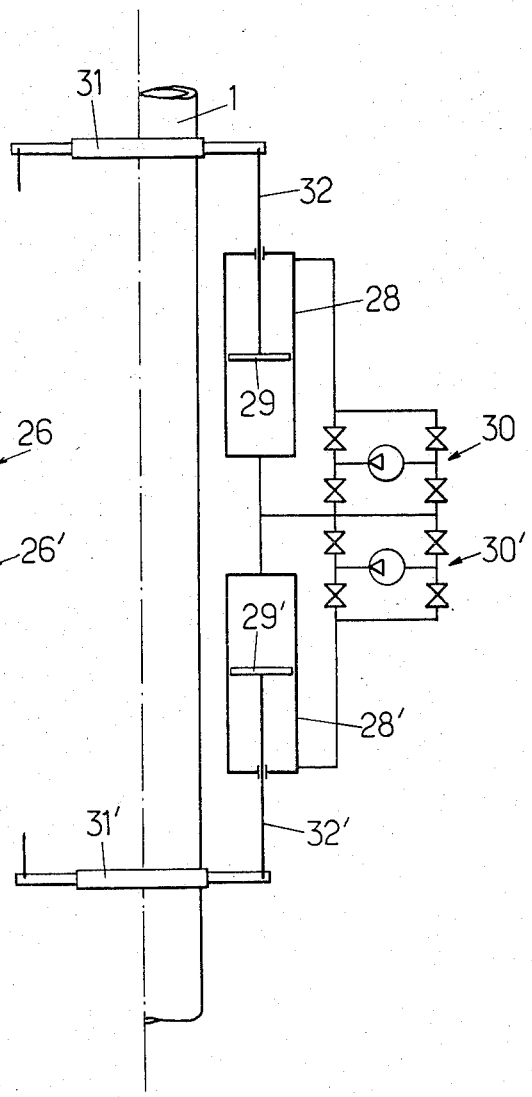
FIG. 3 shows schematically a further installation in accordance with the invention, of the type comprising two jack assemblies, with conventional jack pairs.

In FIGS. 2 and 3 there have also been shown schematically other embodiments of an installation also in accordance with the invention.

In FIG. 2, where the locking means 8, 8' on object 1 may be of the same type as in FIG. 1, two separate annular jack bodies 24 and 24' have been provided surrounding the oblong object 1 and in each of which is mounted a piston also annular, respectively 25 and 25'. The means for supplying the two separate jack bodies with hydraulic fluid may be of the same type as those which have been previously described and they have been shown generally at 26 for body 24 and at 26' for body 24'. Similarly to the case for FIG. 1, there is communication between the two jack bodies 24 and 24' provided by a connection shown at 27, 27', but it should be understood that there could also be separation between the two jack bodies 24 and 24' and complete independence between the hydraulic fluid supplies.

The operation may in any case be similar to that described with reference to FIG. 1.

The same remarks go for the embodiment of FIG. 3. In this figure, there is shown, instead of annular jacks, monojacks whose bodies have been shown at 28 and 28' and pistons at 29 and 29'. Their supply may be provided as in FIG. 2 (supplies 30 and 30'). In the figure, there has only been shown a single pair of jacks but in actual fact several pairs will be used spaced evenly apart about object 1 so as to balance the forces exerted by piston 29, 29' on this object.

Here again, this object may be any object whatsoever and there are shown in FIG. 3 locking means 31 and 31' of the type with clamping collars. Of course, if such collars are used the clamping and unclamping of the collars on object 1 can be controlled automatically from appropriate control signals, for example electric or hydraulic signals.

In this case of application, disengagement between pistons 29, 29' and the oblong object 1 may also be envisaged, not at the level of the clamping collars or similar 31, 31' but at the level of the connection between the ends of rods 32 and 32' of the pistons as well as a member for engagement with object 1, which member would then be mounted permanently on this latter.

As is evident, and as it follows moreover already from what has gone before, the invention is in no wise limied to those of its modes of application and embodiments which have been more especially discussed; it embraces, on the contrary, all variations thereof.

I claim:

1. A propulsive-force jack apparatus for producing continuous movement of an oblong object in an axial direction and/or of an element along a said oblong object, said apparatus comprising at least two jack assemblies, each of which comprises a piston slidably movable in a corresponding jack body, locking means associated with the piston of each assembly for interlocking the pistons selectively, momentarily and automatically with the object, a device for supplying hydraulic fluid to said jack assemblies, and an automatic control means for controlling said locking means and for controlling supplying of said hydraulic fluid to, and the discharging of said hydraulic fluid from, said jack bodies such that engagement of said object by a said piston of one of said jack assemblies is effected in a continuous manner at the moment when the said piston of the other jack assembly is disengaged from said object and such that the relative movement of the piston of one assembly with respect to the piston of the other assembly is a synchronous seesaw movement, the offload movement of the piston of each of the jack assemblies being faster than the movement under load, effected in the opposite direction, of the piston of the other jack assembly, wherein each movement, under load, of said piston of each jack assembly is preceded by a short off-load movement of the same piston in the same direction, said automatic control means comprising, for each jack assembly, a first sensor for detecting the arrival of the respective piston of the corresponding body at a position (N2, N2') situated just before the end (N1, N1') of the movement of that piston under load, said first sensor being connected, through an amplifier, to the said device for supplying hydraulic fluid to the jack assemblies responsive to detecting the arrival of said respective piston at said position such that this device automatically controls the beginning of an offload movement of the piston of one of the other jack assemblies in the direction of movement of said object relative to said assembly at a moment which precedes the arrival at the end of travel in the same direction, of the piston under load.

2. Apparatus according to claim 1, wherein said automatic control means further comprises, for each jack assembly, a second sensor for detecting the arrival of the respective piston of the corresponding body at a position (N3, N'3) situated just after the beginning of its movement under load, said second sensor being connected, through an amplifier, to the said device for supplying hydraulic fluid to the jack assemblies responsive to detecting the arrival of said respective piston at the position detected by said second sensor so that this device automatically controls the beginning of the offload return movement of a said piston of each jack assembly in the direction opposite to the direction of relative movement of the object with respect to that jack assembly at a time which follows the beginning of the said travel, under load, of the piston of the other jack assembly.

3. Apparatus according to claim 2, wherein said automatic control means further comprises, for each jack assembly, a third sensor detecting the arrival of the respective piston of the corresponding body at the end (N1,N'1) of its travel under load, said third sensor being connected, through an amplifier, to the said device for supplying hydraulic fluid to the jack assemblies so that this device automatically controls the beginning of the travel under load of the piston of the other jack assembly, after which said automatic control means control said locking means so as to provide, again, momentary disengagement between the piston of the first cited jack assembly and said oblong object, just before the beginning of the offload return movement of said piston.

4. Apparatus according to claim 2, wherein said automatic control means further comprises, for each jack assembly, a fourth sensor detecting the arrival of the respective piston at the end (N4, N'4) of its offload return movement, said fourth sensor being connected, through an amplifier, to the said device for supplying hydrualic fluid to the jack assemblies so that this device automatically controls the stop of said offload return movement, following which said automatic control means controls said locking means so as to provide, again, momentary engagement between the said piston and said oblong object, just before the beginning of the movement under load of said piston.

5. Apparatus according to claim 1 wherein the jack bodies of each of said jack assembly comprise a first chamber and a second chamber separated by a said piston, the first chamber of one of the jack assemblies being connected to the first chamber of the other jack assembly, and said automatic control means comprising a hydraulic circuit comprising, for each jack assembly, a group of four valves forming two pairs of two valves which two valves are connected together, and therefore have a common point, each of said pairs of each group being connected between said first chamber and said second chamber of the corresponding jack assembly, and a pump being connected, in each group, between the said common point of one of said pairs of valves, and the said common point of the other pair of valves.

6. Apparatus according to claim 1 wherein the jack bodies of each of said jack assembly comprise a first chamber and a second chamber separated by a said piston, and the two first chambers being common, and said automatic control means comprising a hydraulic circuit comprising, for each jack assembly, a group of four valves forming two pairs of two valves which two valves are connected together, and therefore have a common point, each of said pairs of each group being connected between said first chamber and said second chamber of the corresponding jack assembly, and a pump being connected, in each group, between the said common point of one of said pairs of valves, and the said common point of the other pair of valves.

7. Hydraulic circuit for supplying hydraulic fluid to two jack assemblies according to a predetermined sequence of driving and returning steps such that there is no gap between the driving step of one of the jack assemblies and the following driving step of the other, each said jack assembly comprising a first chamber and a second chamber, and said first and second chambers being separated by a piston, and the first chamber of one of the jack assemblies being connected to the first chamber of the other jack assembly, said hydraulic circuit further comprising, for each jack assembly, a group of four valves operable responsive to the position of the associated piston of the corresponding jack assembly for selectively controlling the supply of hydraulic fluid to said corresponding jack assembly, said four valves forming two pairs of two valves and each of the two valves of the two pairs of two valves being connected together, and therefore having a common point, each of said pairs of each group being connected between said first chamber and said second chamber of the corresponding jack assembly, and a pump in each group for pumping said hydraulic fluid to the corresponding hydraulic jack under the control of said control valves, said pump being connected, in each group, between the said common point of one of said pairs of valves, and the said common point of the other pair of valves.

8. Hydraulic circuit for supplying hydraulic fluid to two jack assemblies according to a predetermined sequence of driving and returning steps such that there is no gap between the driving step of one of the jack assemblies and the following driving step of the other, each said jack assembly comprising a first chamber and a second chamber, the first and second chambers being separated by a piston, and the two first chambers being common, said hydraulic circuit further comprising, for each jack assembly, a group of four valves operable responsive to the position of the associated piston of the corresponding jack assembly for selectively controlling the supply of hydraulic fluid to said corresponding jack assembly, said four valves forming two pairs of two valves and each of the two valves of the two pairs of two valves being connected together, and therefore having a common point, each of said pairs of each group being connected between said first chamber and said second chamber of the corresponding jack assembly, and a pump in each group for pumping said hydraulic fluid to the corresponding hydraulic jack under the control of said control valves, said pump being connected, in each group, between the said common point of one of said pairs of valves, and the said common point of the other pair of valves.

* * * * *